US005174357A

United States Patent [19]

Allen

[11] Patent Number: 5,174,357

[45] Date of Patent: Dec. 29, 1992

[54] CASTING DIE

[75] Inventor: Gordon L. Allen, Rugby, England

[73] Assignee: AE Piston Products Limited, Braford, England

[21] Appl. No.: 522,587

[22] Filed: May 11, 1990

[30] Foreign Application Priority Data

May 27, 1989 [GB] United Kingdom ..... 8912288

[51] Int. Cl.[5] ..... B22D 15/02

[52] U.S. Cl. ..... 164/340; 164/342; 164/343; 164/DIG. 8

[58] Field of Search ..... 164/340, 342, 343, DIG. 8, 164/137

[56] References Cited

U.S. PATENT DOCUMENTS

| | | | |
|---|---|---|---|
| 1,396,341 | 11/1921 | Rautenbach . | |
| 2,286,994 | 6/1942 | Nocar | 164/340 X |
| 2,287,524 | 6/1942 | Jackson | 164/340 X |
| 2,527,537 | 10/1950 | Fahlman et al. | 164/340 X |
| 2,581,418 | 1/1952 | Kohl | 164/340 X |
| 2,965,938 | 12/1960 | Davis . | |
| 3,283,374 | 11/1966 | Peras | 164/340 |
| 4,020,894 | 5/1977 | McCoy et al. . | |
| 4,162,700 | 7/1979 | Kahn . | |
| 4,301,856 | 11/1981 | Di Rosa | 164/340 |

FOREIGN PATENT DOCUMENTS

| | | | |
|---|---|---|---|
| 388820 | 1/1924 | Fed. Rep. of Germany | 164/DIG. 8 |

OTHER PUBLICATIONS

Patent Abstracts of Japan, vol. 4, No. 41 (M-5), relating to JP 55-14187 published Jan. 31, 1980.

Patent Abstracts of Japan, vol. 8, No. 263 (M-342), relating to JP 59-137151 published Aug. 7, 1984.

*Primary Examiner*—J. Reed Batten, Jr.

*Attorney, Agent, or Firm*—William R. Hinds

[57] ABSTRACT

The die for the production of piston blanks having high dimensional accuracy comprises an integral body and crown forming part with separate internal and pin boss bore cores and a single runner and feeder. Metal utilisation is greatly increased and fettling costs are greatly reduced.

6 Claims, 3 Drawing Sheets

CASTING DIE

The present invention relates to a die for gravity casting of piston blanks particularly, though not exclusively, for internal combustion engines and compressors.

Gravity cast piston blanks have up to now been produced by multi-piece split die systems. Such dies typically comprise a generally rectangular part split into two halves along a diametral plane passing through the generally cylindrical cavity axis, a separate core piece to form the external crown features and an internal, multi-piece collapsable core and optional gudgeon pin boss cores.

The problems with such die assemblies have included the necessity of using large section feeders to minimise shrinkage porosity and which have not always been successful, poor metal utilisation and scrap cast blanks due to inaccuracies arising out of poor mating of the constituent die components.

It is necessary with the blanks produced in conventional casting dies firstly, to saw off the feeders which may be up to around 25 mm thick and secondly, to proof turn the fettled castings. Proof turning removes excess metal, provides a suitably accurate outside surface for subsequent machining and is also used to check for porosity.

Conventional blanks after fettling may utilise only 40% to 50% of the weight of poured metal. After machining, due to the generous allowances used for proof turning, the eventual metal utilisation may be only around 25 to 35%.

Inaccuracy in orientation of the various piston features arises from necessary clearances between mating parts, residual die flash, and from coatings and foreign matter preventing accurate mating of the die components.

It is an object of the present invention to provide a casting die for the production of piston blanks having high dimensional accuracy, high metal utilisation and which are amenable to a single finish machining operation on the outer diameter after removal of the metal runner system only.

It will be appreciated by those skilled in the casting art that the runner system is distinct and different from the feeder system in a casting die.

According to the present invention a gravity casting die for the production of piston blanks comprises a single piece body portion having a generally cylindrical cavity, a crown forming portion fixed relative to the body portion, at least one aperture passing through the body portion for molten metal access into the cavity, molten metal guidance means associated with said at least one aperture, a feeder associated with the crown forming portion, gudgeon pin boss cores, said cores being slidably engagable into their required position and a removable internal core which when in position in the body portion defines a 3-dimensional, piston shaped cavity bounded by the surfaces of the body cavity, the crown portion, the pin boss cores and the internal core.

Preferably there is a single metal runner access aperture into the die cavity. The form of the aperture is preferably in the form of a low cross sectional area slit which allows the solid metal runner on the casting to be broken off rather than cut off. Where there is more than one runner they are preferably all of the same form. Fettling costs are greatly reduced in this way.

Preferably die heating means in the form of, for example, cartridge heaters are included adjacent the crown feeder. The feeder is preferably in the centre of the crown in the form of a relatively small frusto-conical protuberance which may be removed during the single external machining operation. For the types of aluminium alloys normally employed in piston castings the heating means may maintain the feeder in the region of about 600° C. during solidification of the remainder of the piston casting. Other cavities may be incorporated into the die body for the circulation of either calorific oil for heating purposes or of water for cooling; the use of either or none depending upon the requirements and geometry of the casting.

The internal core may be of conventional multi-piece construction and be assembled and disassembled in the die cavity by known means.

The gudgeon pin boss cores may also form piston side panel features. The piston side panels are those external piston areas lying adjacent the gudgeon pin bores and may take many varied forms. An example of a piston which may be cast in this manner is the so called "slipper" type of piston where the side panel areas tend to be substantially planar panels extending between the thrust and counter thrust faces of the piston. The external side panel features may include ribs and flanged regions.

Using the die of the invention, pistons have been reliably and repeatably produced with a metal utilisation of 85 to 90% in the fettled, premachined casting.

Sound, porosity-free castings having a maximium machining allowance of 1.5 mm on the outer diameter have been produced together with side panel features which remain in the unmachined, as-cast condition and have a wall thickness of only 2.5 mm.

Pistons having an unmachined crown and nominal crown wall thickness of 4.25 mm with a tolerance of +or −0.25 mm have been repeatably produced within tolerance with a zero scrap rate, due mainly to the fact that the crown and die body are in fixed relationship with each other and no dimensional inaccuracies can occur on assembly.

In order that the present invention may be more fully understood an example will now be described by way of illustration only with reference to the accompanying drawings, of which;

Figure 1:
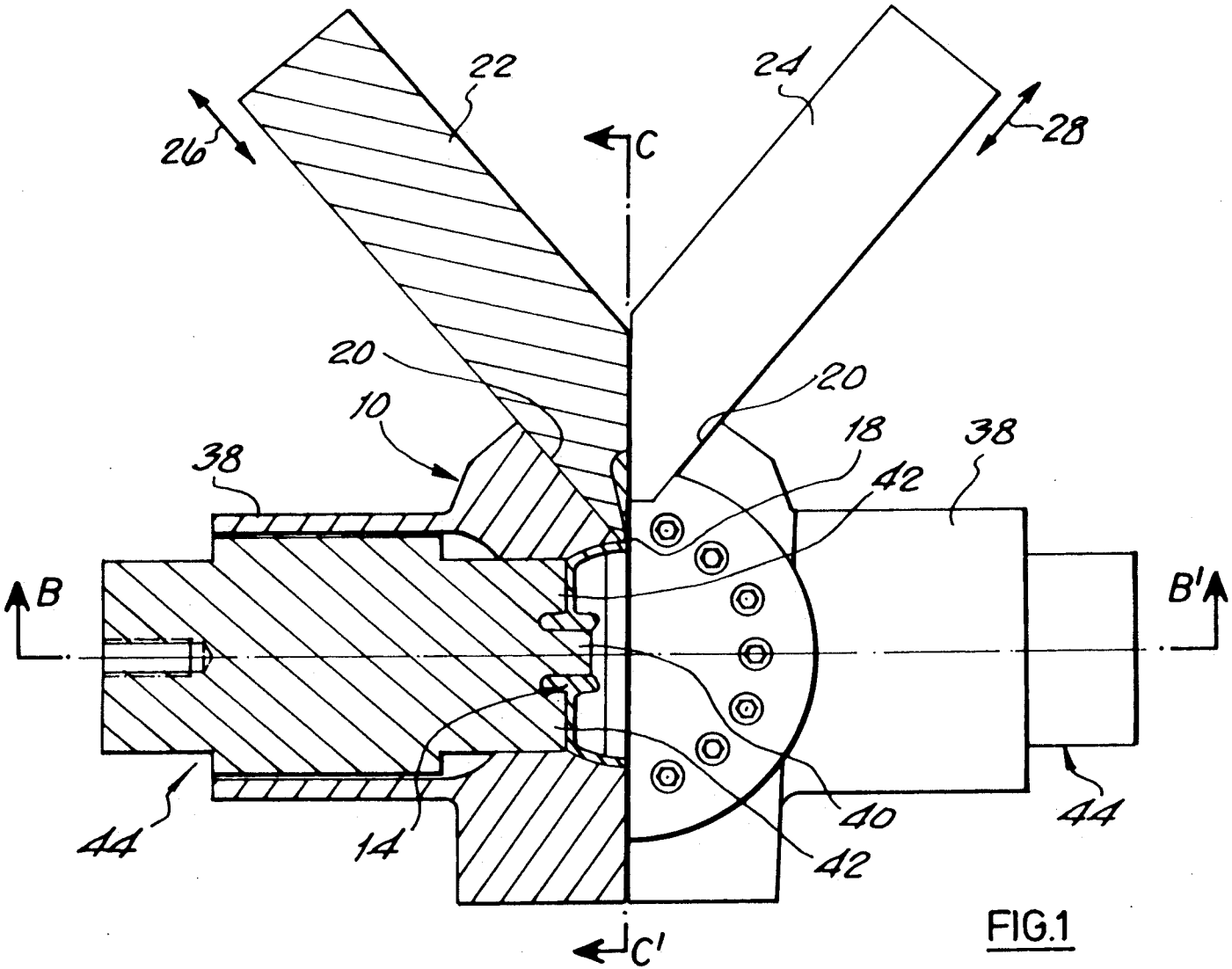
FIG. 1 shows in the left hand half a section through the die shown in FIG. 2 along the line AA' looking in the direction of the arrows, whilst the right hand half is a plan view of the die of FIG. 2.
Figure 2:
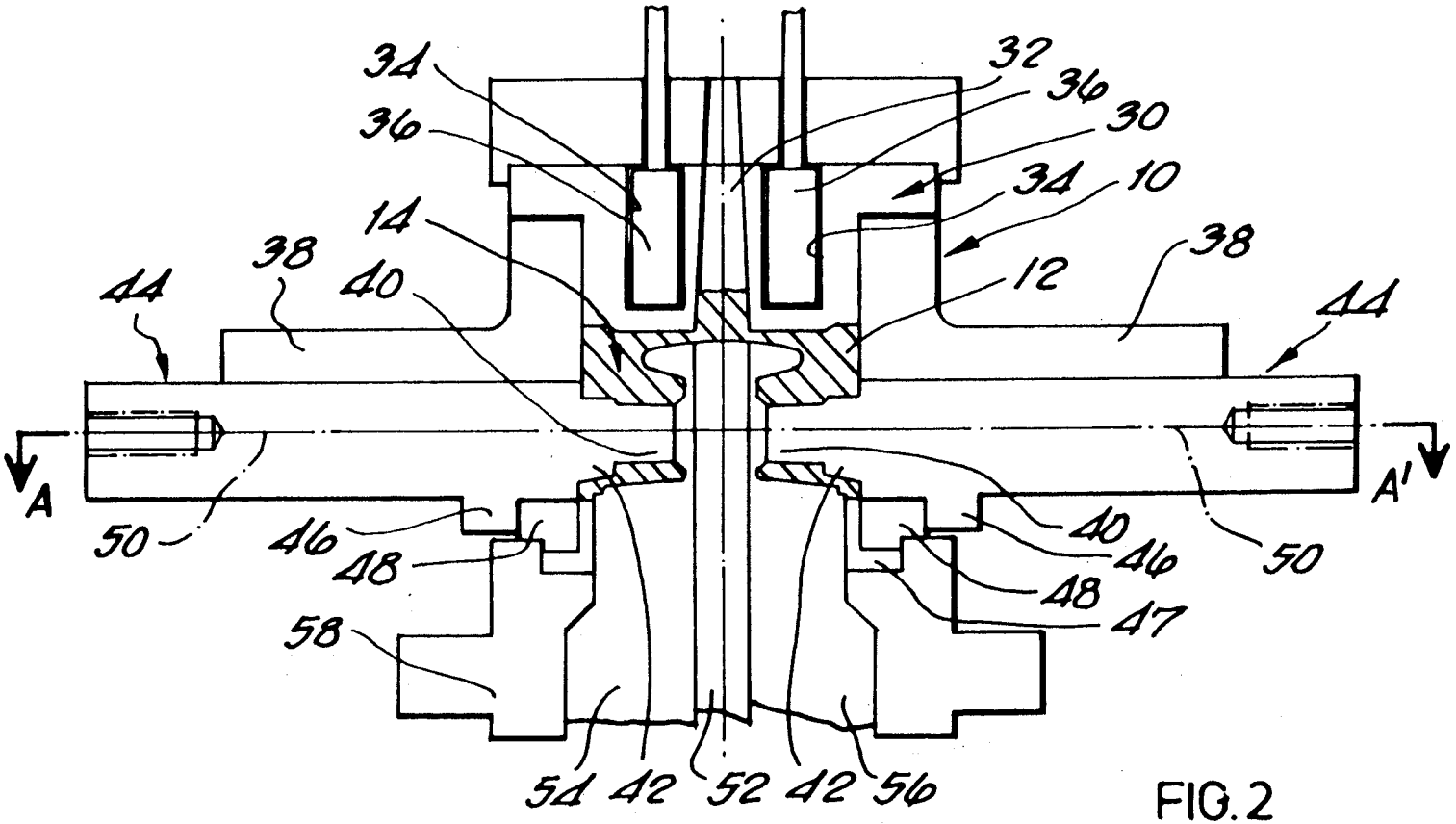
FIG. 2 shows a section in elevation of the die of FIG. 1 along the line BB' looking in the direction of the arrows.
Figure 3:
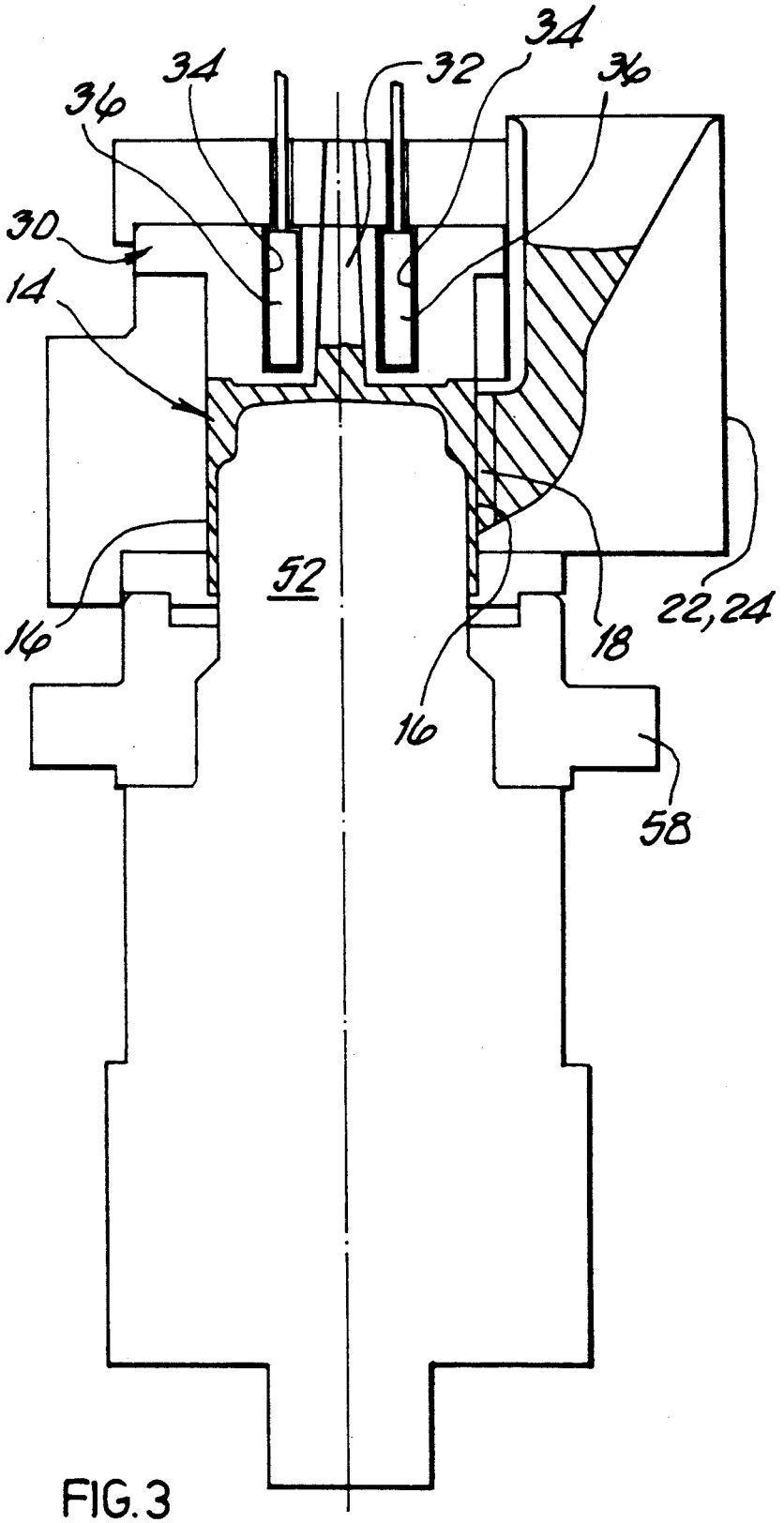
FIG. 3 which shows a section in elevation of the die of FIG. 1 along the line CC' looking in the direction of the arrows.

Referring now to the figures and where the same features are denoted by common reference numerals. The gravity casting die comprises a generally, internally cylindrical die body member 10 which forms the piston ring belt region 12 of the piston casting 14 and at least the thrust faces 16 of the piston skirt. The body member 10 has a narrow, axially directed slit 18 through the internal die wall which opens out into a Vee-shaped housing 20 for two mating runner block components 22, 24 and which components slide in directions 26, 28 in order to be mated with and withdrawn from the body 10. The top of the body 10 has a crown forming portion 30 which is rigidly fixed to the body 10 with screws (not shown) the crown portion 30 has a central, frusto-conical feeder 32 and bores 34 for receiving electrical cartridge heaters 36. The body 10 has lateral extensions 38 which form guide/slideways for gudgeon pin boss 40 and side panel feature 42 cores 44. Stops 48, 46 are provided on a base assembly 47, 48, 58 and cores 44 respectively to limit and control the position of the cores which slide in the direction of the axis 50. The interior cavity of the piston casting 14 is formed by a multi-piece collapsable core which in this case comprises a central plate assembly 52 and two side pieces 54, 56. The interior core is moved within a rigid base assembly 58 by known manipulating means (not shown) the cores 44 are driven by pneumatic or hydraulic means (not shown) as are the runner blocks 22, 24. The die body 10 and crown portion 30 assembly is raised and lowered by pneumatic or hydraulic means (not shown). The electrical cartridge heaters are connected to a power supply (not shown).

In operation the core pieces 52, 54 , 56 are assembled and the die body/crown assembly lowered onto the base 58, the cores 44 are slid into position against the stops 46, 48 and the runner blocks 22, 24 are brought into mating engagement with the die body 10. The crown portion 30 is heated by the heaters 36 to a temperature of around 600° C. where the metal to be cast is an aluminium-silicon alloy of for example, the Lo-eX (trade name) type. Molten metal is poured into the cavity formed by the runner blocks 22, 24, the metal filling the die cavity and the feeder 32. The small feeder so formed is maintained in the molten state until the remainder of the casting 14 has solidified. The casting 14 is removed from the die by withdrawing the runner blocks 22, 24, withdrawing the cores 44, vertically withdrawing the die body/crown assembly 10, 30 from the casting 14 which is held in position by the assembled internal core which is finally removed to release the casting.

Since the runner is connected to the casting 14 only by a thin section of metal it may merely be knocked off. The casting 14 is free from bulky feeders and the outer surface may be machined in a single operation without the need for further fettling of the casting nor for a prior proof turning operation to remove excess metal.

The die of the present invention may where necessary be used in conjunction with appropriate manipulating equipment to produce castings having for example, steel thermal expansion control members encast within the piston.

I claim:

1. A gravity casting die for the production of piston blanks, the die comprising a single body portion having a generally cylindrical cavity, a crown forming portion fixed relative to the body portion, at least one aperture passing through the body portion for molten metal access into the cavity, molten metal guidance means associated with said at least one aperture, a feeder associated with the crown forming portion, gudgeon pin boss cores, said cores being slidably engagable into their required position and a removable internal core which when in position in the body portion defines a 3-dimensional, piston shaped cavity bounded by the surfaces of the body cavity, the crown portion, the pin boss cores and the internal core.

2. A die according to claim 1 wherein said aperture through the body portion is a low cross sectional area slit.

3. A die according to claim 1 also having heating means adjacent said crown a portion.

4. A die according to claim 2 also having heating means adjacent said crown portion.

5. A die according to claim 1 having passages and cavities for the circulation of heating fluid or cooling fluid.

6. A die according to claim 1 wherein said gudgeon pin boss cores also form piston side panel features.

* * * * *